US007275394B2

(12) United States Patent
Lundberg

(10) Patent No.: US 7,275,394 B2
(45) Date of Patent: Oct. 2, 2007

(54) HEAT EXCHANGER HAVING A DISTRIBUTER PLATE

(75) Inventor: Erik L. Lundberg, Berkley, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 221 days.

(21) Appl. No.: 11/112,066

(22) Filed: Apr. 22, 2005

(65) Prior Publication Data

US 2006/0236718 A1 Oct. 26, 2006

(51) Int. Cl.
*P25B 39/02* (2006.01)
*F25B 41/06* (2006.01)

(52) U.S. Cl. ..... 62/515; 62/527; 165/DIG. 483

(58) Field of Classification Search ..... 62/515, 62/524, 525, 527; 165/153, 174, DIG. 466, 165/DIG. 483
See application file for complete search history.

(56) References Cited

U.S. PATENT DOCUMENTS 3,674,652 A * 7/1972 Brown ..... 203/11
3,965,976 A 6/1976 Barton
3,996,897 A 12/1976 Herzog
4,206,802 A 6/1980 Reed et al.
4,231,424 A 11/1980 Moranne
5,174,373 A 12/1992 Shinmura
5,203,407 A 4/1993 Nagasaka
5,415,223 A 5/1995 Reavis et al.
5,582,239 A 12/1996 Tsunoda et al.
5,669,439 A * 9/1997 Hasegawa et al. ..... 165/153
5,931,020 A * 8/1999 Nakamura ..... 62/527
5,934,367 A * 8/1999 Shimmura et al. ..... 165/174
5,941,303 A 8/1999 Gowan et al.
6,161,616 A * 12/2000 Haussmann ..... 165/176
6,199,401 B1 * 3/2001 Haussmann ..... 62/525
6,241,011 B1 * 6/2001 Nakamura et al. ..... 165/153
6,257,325 B1 * 7/2001 Watanabe et al. ..... 165/153
6,449,979 B1 9/2002 Nagasawa et al.
6,530,423 B2 * 3/2003 Nakado et al. ..... 165/153
6,536,517 B2 3/2003 Hoshino et al.
6,543,528 B2 4/2003 Saito et al.
6,568,205 B2 * 5/2003 Bureau et al. ..... 62/515
6,581,679 B2 6/2003 Fischer et al.
6,786,277 B2 * 9/2004 Hark et al. ..... 165/178
2003/0006029 A1 1/2003 Kelsey
2003/0188857 A1 10/2003 Kawakubo et al.
2004/0079516 A1 4/2004 Leeson et al.
2004/0134650 A1 7/2004 Acre (Continued)

FOREIGN PATENT DOCUMENTS

JP 6-11291 A * 1/1994

(Continued)

*Primary Examiner*—Mohammad M. Ali
(74) *Attorney, Agent, or Firm*—Brinks Hofer Gilson & Lione

(57) ABSTRACT

A heat exchanger for a motor vehicle is provided, including top and bottom headers and a core extending therebetween. The top header includes a distributor plate extending along the longitudinal axis thereof to separate the top header into first and second chambers. The distributor plate includes at least one opening to permit effective distribution of the liquid between the respective chambers. One type of effective distribution causes the liquid to be generally equally distributed among each of the plurality of flow tubes.

28 Claims, 6 Drawing Sheets

U.S. PATENT DOCUMENTS

| | | | |
|---|---|---|---|
| 2004/0159121 | A1 | 8/2004 | Horiuchi et al. |
| 2005/0006069 | A1 | 1/2005 | Kamiyama et al. |
| 2005/0006080 | A1 | 1/2005 | Kamiyama et al. |
| 2005/0039901 | A1 | 2/2005 | Demuth et al. |

FOREIGN PATENT DOCUMENTS

| | | | |
|---|---|---|---|
| WO | WO 02/103263 | A1 | 12/2002 |

* cited by examiner

HEAT EXCHANGER HAVING A DISTRIBUTER PLATE

BACKGROUND

1. Field of the Invention

The invention relates generally to heat exchanger for a motor vehicle. More specifically, the invention relates to a heat exchanger, such as an evaporator, having a distributor plate for improving the flow of refrigerant through the heat exchanger flow tubes.

2. Related Technology

Air conditioning systems for motor vehicles typically have a refrigeration cycle that circulates a refrigerant in order to control the temperature within the passenger compartment of the motor vehicle. During the refrigeration cycle, the refrigerant flows into a compressor, causing an increase in both pressure and temperature of the fluid. Exiting the compressor in a gaseous phase, the refrigerant is then condensed into a low-temperature liquid phase by a condenser. Next, the refrigerant flows through an expansion valve, which causes the refrigerant to expand into a low-pressure, low-temperature mixture of gas and liquid. The mixture of gas and liquid then flows into the evaporator and cools the passenger compartment to a desired temperature.

More specifically, after the refrigerant enters the evaporator it flows through a bank of thin, heat-transfer tubes that extend across the evaporator. The tubes are exposed to an influx of warm, ambient air that flows across the bank of tubes and absorbs heat therefrom; thereby causing all or most of the liquid portion of the refrigerant to evaporate into a gaseous state. The influx of air, having been sufficiently cooled, then enters the passenger compartment at the desired temperature.

Due to natural properties of fluids, evaporating liquids are able to absorb a certain amount of heat before increasing the temperature of the resulting gas. Therefore, to maximize the cooling effect of the air conditioner, and thus maximize the efficiency of the air conditioning system, it is advantageous for the liquid portion of the refrigerant entering the evaporator to be completely transformed into a gaseous state by the ambient air. One known technique for promoting phase-changes of the refrigerant is by increasing the amount of time that the refrigerant is exposed to the influx of air, such as by increasing the number of times that the refrigerant flows across the bank of heat-transfer tubes. However, this design increases the space required to house the evaporator within the motor vehicle.

As an alternative or an additional solution to the above-described design, the evaporator may have heat-exchange tubes with relatively small cross-sectional areas. However, smaller tubes typically cause uneven distribution of the gaseous-liquid mixture within the different tubes. More specifically, some of the tubes will tend to have an unproportionally high percentage of gas contained therein while other tubes will tend to have an unproportionally high percentage of liquid flowing therethrough. The uneven distribution of two-phase refrigerant may cause some or most of the liquid refrigerant to exit the tubes without evaporating, thereby decreasing the efficiency of the system.

It is therefore desirous to provide an air conditioning system that maintains a desired efficiency by equally distributing the liquid-phase refrigerant among the respective heat exchange tubes in the evaporator.

SUMMARY

In overcoming the limitations and drawbacks of the prior art, the present invention provides a heat exchanger having top and bottom headers and a core extending between the headers. The core includes a set of flow tubes that each permit a liquid to travel therethrough. Additionally, the top header includes a distributor plate extending along a longitudinal axis of the top header to define first and second chambers. The distributor plate includes at least one opening to permit a desired distribution of the liquid between the respective chambers. One type of a desired distribution, for example, causes the liquid to be generally equally distributed among each of the plurality of flow tubes.

In one aspect, the distributor plate defines a collection area for collecting the liquid. The openings define a boundary of the collection area such that the liquid is substantially prevented from flowing through the opening until the liquid reaches the boundary. The distributor plate is therefore configured to distribute the liquid substantially evenly along the length of the distributor plate. The liquid is preferably evenly distributed when the liquid is flowing at a relatively low flow rate, such as 1.5 pounds per minute or less.

In another aspect of the present invention, the distributor plate is obliquely oriented with respect to the vertical. Described another way, the distributor plate extends along a plane that defines an angle with respect to an axis of the flow tubes that is greater than or equal to 0 degrees and less than 90 degrees. For example, the angle is between 35 and 85 degrees or is more preferably between 60 and 70 degrees.

The distributor plate and the top header may be formed as a single, unitary component. The component may also include a divider plate dividing the top header into a pair of passages.

In a further embodiment, the distributor plate includes a plurality of openings, each of which fluidly connects the first and second chambers with each other. The openings are positioned along the distributor plate such as to cooperate with each other to define the boundary of the collection area.

Further objects, features and advantages of this invention will become readily apparent to persons skilled in the art after a review of the following description, with reference to the drawings and claims that are appended to and form a part of this specification.

DETAILED DESCRIPTION

Figure 1:
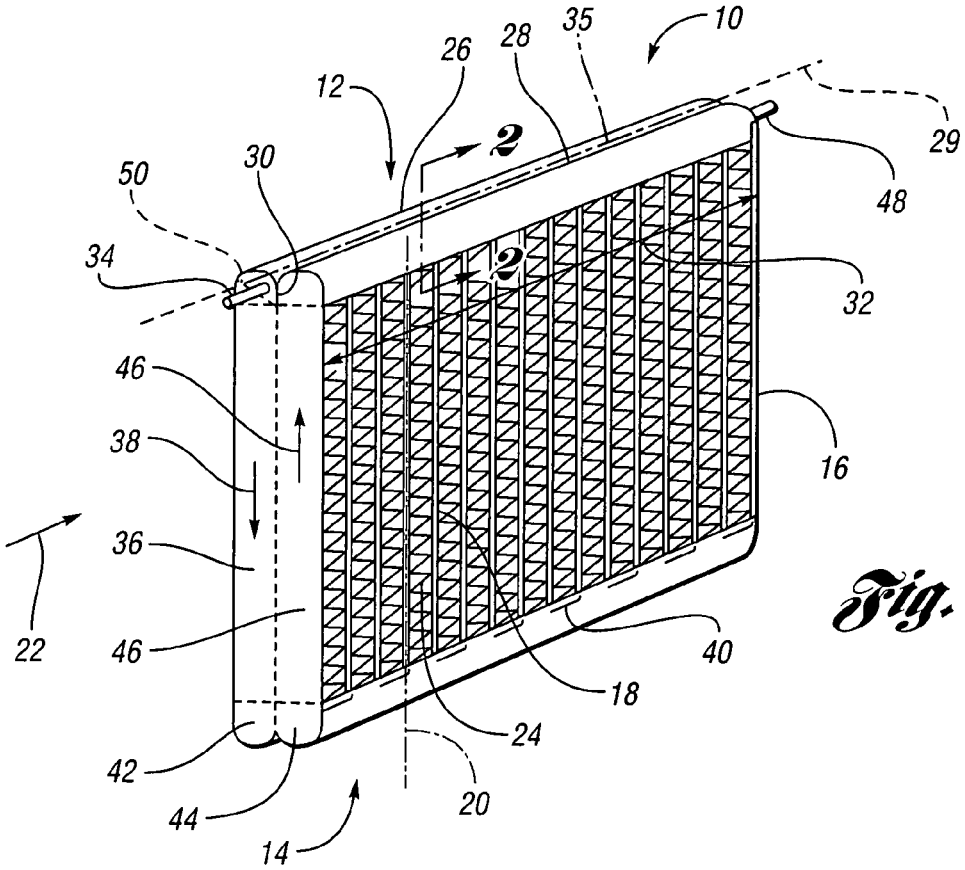
FIG. 1 is an isometric view of a heat exchanger for the air conditioning circuit of a motor vehicle embodying the principles of the present invention, where the heat exchanger includes top and bottom headers and a core extending therebetween.

Referring now to the drawings, FIG. 1 shows a heat exchanger, such as an evaporator 10, for use in an air conditioning system. The evaporator 10 includes top and bottom headers 12, 14 and a core 16 extending therebetween that fluidly connects the respective headers 12, 14 to each other. More specifically, the core includes a plurality of flow tubes 18 extending along an axis 20 and being configured to permit heat exchange between a refrigerant flowing through the flow tubes 18 and an airstream 22 flowing across the core 16. The flow tubes 18 are preferably made of a thermally conductive material, such as aluminum, and have relatively thin walls to promote heat exchange with the airstream 22. To further promote heat exchange, one or more fins 24 extend in a serpentine fashion between each of the pairs of adjacent flow tubes 18.

The top header 12 shown in FIG. 1 includes an inlet tank 26 and an outlet tank 28, both extending generally parallel to each other in a longitudinal direction 29 and being separated from each other by a divider plate 30 that extends substantially completely along the length 32 of the top header 12. The divider plate 30 forms a substantially fluid-tight seal that prevents direct fluid communication between the respective tanks 26, 28.

The inlet tank 26 receives the refrigerant from an inlet 34 extending through an end or a sidewall of the inlet tank 26 side wall such that the refrigerant is permitted to flow along a first passageway 35 defined by the top header 12. The fluid then enters a first set 36 of the flow tubes 18 and flows in a downward direction 38 to the bottom header 14. Similar to the top header 12, the bottom header 14 extends in the longitudinal direction 29 and defines a second passageway 40 for the fluid. However, unlike the top header 12, the bottom header 14 shown in the Figures does not include a divider plate (further described below) that fluidly separates respective sides 42, 44 of the bottom header 14. More specifically, the bottom header 14 is preferably either a single, open tube having no flow restriction between the respective sides 42, 44, or is a partially-divided tube having a restrictor plate (not shown) with openings to guide the liquid flow as desired.

The first side 42 of the bottom header 14 is connected to the first set 36 of flow tubes 18 and the second side 44 is connected to a second set 46 of flow tubes 18. Thus, the fluid is able to exit the bottom header 14 via the second set 46 of flow tubes 18 by flowing in an upward direction 46 towards the outlet tank 28 of the top header 12. The fluid then flows through the outlet tank 28 along a third passageway 45 and exits the evaporator 10 via an outlet 48 that extends through the end or side wall of the outlet tank 28.

Figure 2:
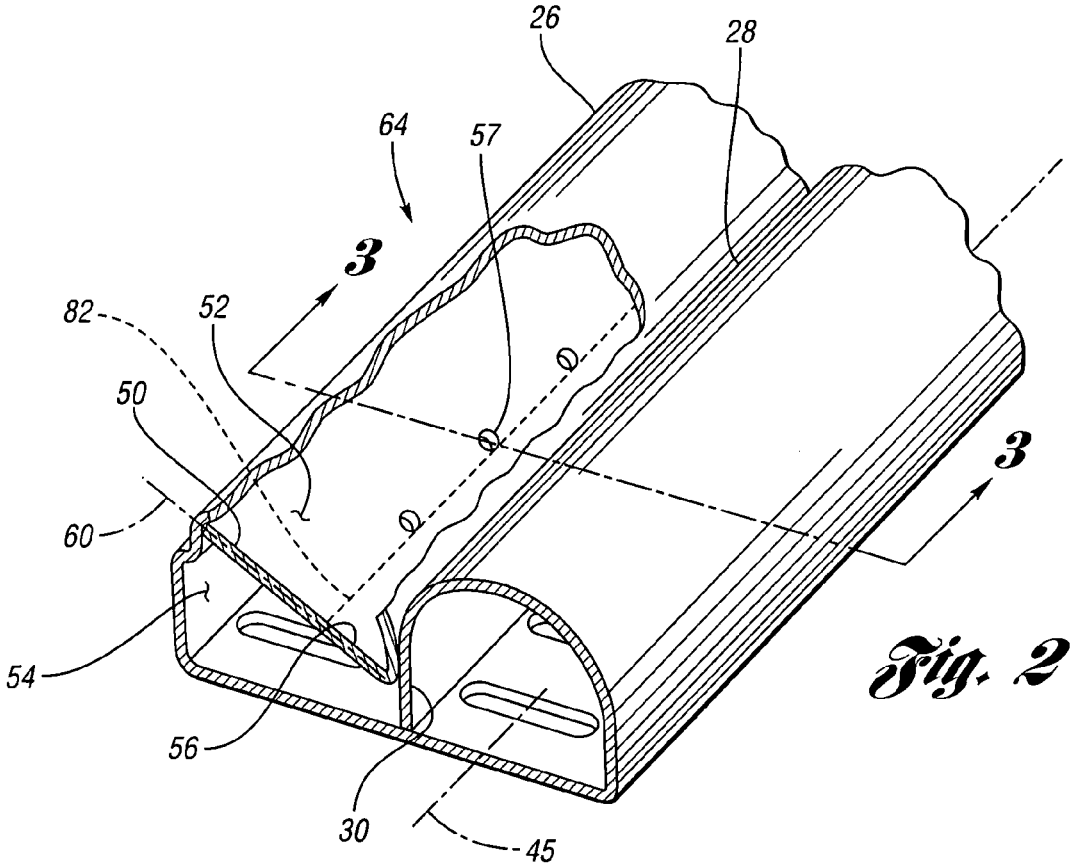
FIG. 2 is an enlarged, isometric view of a portion of the top header shown in FIG. 1 taken along line 2-2 in FIG. 1, wherein the top header includes a distributor plate.

Referring now to FIG. 2, a distributor plate 50 is located within the top header 12 to promote an even distribution of the refrigerant among the plurality of flow tubes. More specifically, the refrigerant entering the evaporator 10 includes a liquid portion and a gaseous portion, and the distributor plate 50 is configured to direct an approximately equal amount of the liquid portion into each of the flow tubes 18. For the purposes of this application, the term, "liquid" is defined as the liquid portion of the refrigerant plus any gaseous portion entrained within the liquid portion.

Figure 3:
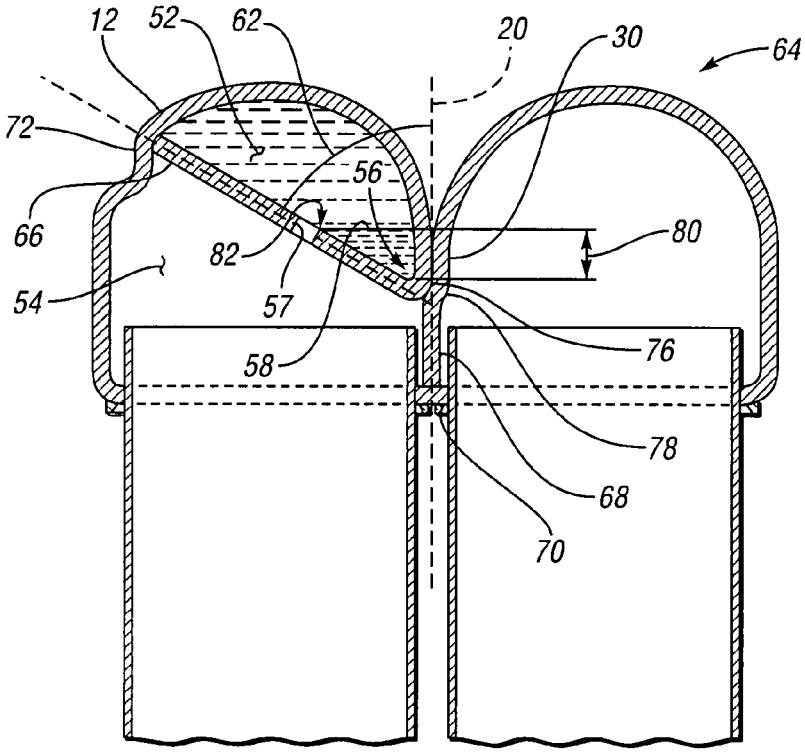
FIG. 3 is a cross-sectional view generally taken along line 3-3 in FIG. 2 and further including flow tubes of the core.

As shown in FIGS. 2 and 3, the distributor plate 50 extends in the longitudinal direction 29 to divide the inlet tank 26 into a first chamber 52, which is fluidly connected to the inlet 34, and a second chamber 54, which is fluidly connected to the first set 36 of flow tubes 18. Within the first chamber 52, the distributor plate 50 defines a collection area 56 that extends along the length of the distributor plate 50 and collects the liquid portion 58 of the refrigerant. The collection area 56 in FIG. 2 is defined by the distributor plate 50 and the top header 12. More specifically, the distributor plate 50 is oriented in a transverse direction 60 to form an angle 62 with respect to the axis 20 of the flow tubes 18 and to cooperate with the top header 12 to define a V-shaped collection area 56. The angle 62 is preferably between 0 and 85 degrees, as measured from the axis 20 in either a clockwise or a counter-clockwise direction. More preferably, the angle 62 is between 45 and 85 degrees; and even more preferably the angle is between 60 and 70 degrees.

The relative orientation between the flow tubes 18 and the distributor plate 50 may vary from that shown in the figures, depending on the angle 62. For example, when the angle 62 is a relatively low angle, such as 0 degrees, the distributor plate 50 is preferably transversely off-set from the flow tubes 18 so that only one of the two chambers 52, 54 is in direct fluid communication with the flow tubes 18.

Once the liquid portion 58 of the refrigerant has been sufficiently collected in the collection area 56, a plurality of openings 57 extending through the distributor plate permit a controlled amount of the liquid portion 58 to flow from the first chamber 52 into the second chamber 54. More specifically, the openings 57 are located a height 80 from the lowest point of the collection area 56, as measured along the axis 20, such that the level of the liquid portion 58 must be at least as great as the height 80 before the liquid portion 58 is able to flow through the openings 57. Therefore, the openings 57 cooperate to define a boundary 82 of the collection area 56 and the liquid portion 58 is substantially prevented from flowing through the openings 57 until reaching the boundary 82.

The boundary 82 shown in FIG. 2 is generally at a constant height to cause a relatively even distribution of the liquid portion 58 to each of the flow tubes 18. The liquid portion 58 may be especially evenly-collected along the top header length 32 when the refrigerant flow rate is relatively low. More specifically, during relatively low flow rates, such as 1.5 pounds per minute or less, the liquid flow is relatively smooth so as to avoid turbulent flow causing the liquid portion 58 to be undesirably splashed onto the upper portion of the distributor plate 50.

In an exemplary flow through the top header 12, the two-phase refrigerant flows through the inlet 34 and into the first chamber 52 of the top header 12. The gaseous portion of the refrigerant typically rises to the top of the first chamber 52, while the liquid portion flows into the collection area 56 along the entire length of the distributor plate 150. Once the collection area 56 has been filled to the level of the boundary 82, the liquid portion 58 begins to flow through each of the respective openings 57 at a substantially equal flow rate. This type of evenly-distributed flow causes the respective flow tubes 18 to each have a substantially equal amount of liquid flowing therethrough, thereby reducing the amount of unevaporated liquid that exits the evaporator 10. Because the gaseous portion of the refrigerant is able to freely flow through the openings 57, it is naturally mixed with the liquid portion 58 that is flowing into the flow tubes 18.

Referring back to FIGS. 1-3, a method of assembling the top header 12 will now be discussed in more detail. The top header 12, the distributor plate 50, and the divider plate 30 shown in FIGS. 1-3 are all formed as a unitary construction. For example, the top header 12 in FIGS. 1-3 is formed from a sheet of material that has a first end 66, a second end 68, and a middle portion 70. The sheet of material is first preferably rolled and/or cut into a desired shape and size. Then, a ridge 72 formed along the sheet, and the two ends 66, 68 of the sheet are bent generally towards each other. Next, the first end 66 of the sheet is connected to the ridge 72 header 12 to provide an improved fluid-tight seal between the respective portions 66, 12 of the component 64. Similarly, the second end 68 is connected to the middle portion 70 to form another fluid-tight seal between the respective portions 68, 70 of the component 64. Additionally, two intermediate portions 76, 78 are connected to each other to form the divider wall 30. Although all of the above-described connections are preferably brazed, any suitable connection may be used.

Figure 4:
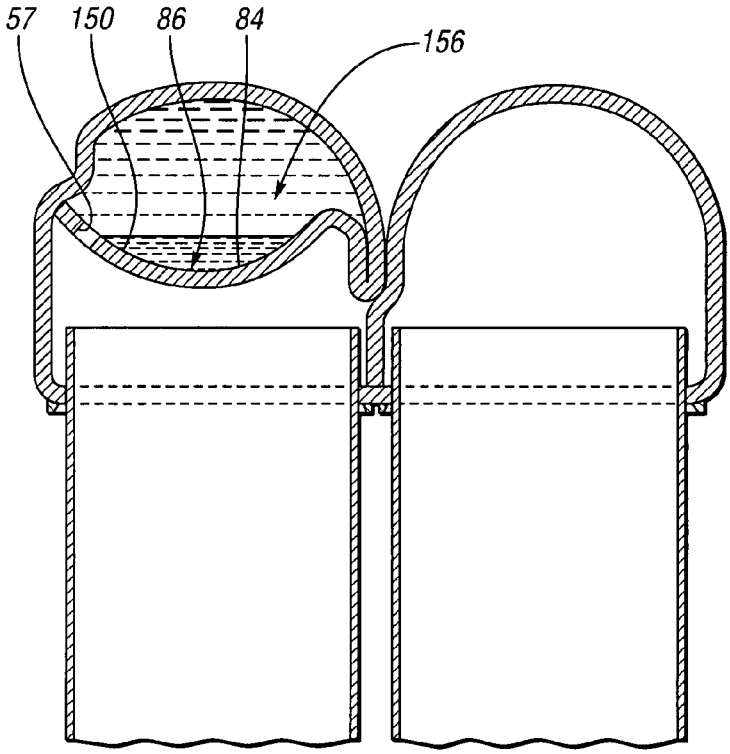
FIG. 4 is a cross-sectional view, similar to that shown in FIG. 3, of another alternative embodiment of the present invention.

Referring now to FIG. 4, an alternative distributor plate 150 design is illustrated therein. The distributor plate 150 in this design is generally non-planar and includes a collection area 156 for collecting the liquid portion 58 of the refrigerant. More specifically, the collection area 156 defines a trough portion 84 having a generally arcuate shape 86. Unlike the design shown in FIG. 3, the distributor plate 150 shown in FIG. 4 does not cooperate with the top header 12 to define the collection area 156.

In yet another design that is not depicted in the figures, the distributor plate may include a pair of trough portions separated by a high point of the distributor plate that defines an opening. In such a design, the opening is centrally located within the first chamber 52.

Figure 5A:
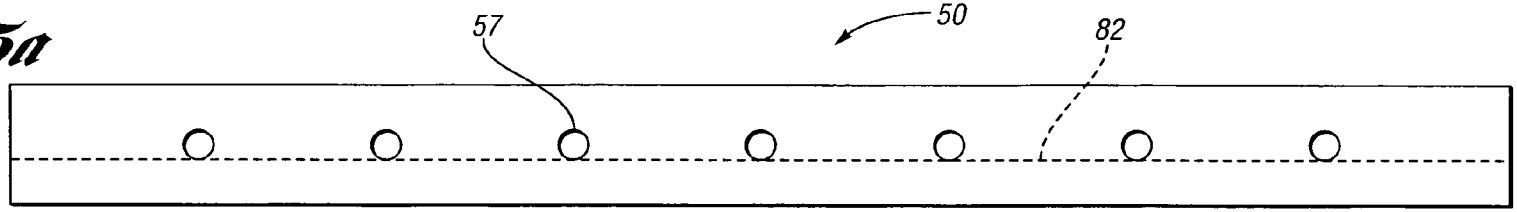
FIGS. 5*a*-5*g* are plan views of various alternative designs of the distributor plate.
Figure 5B:
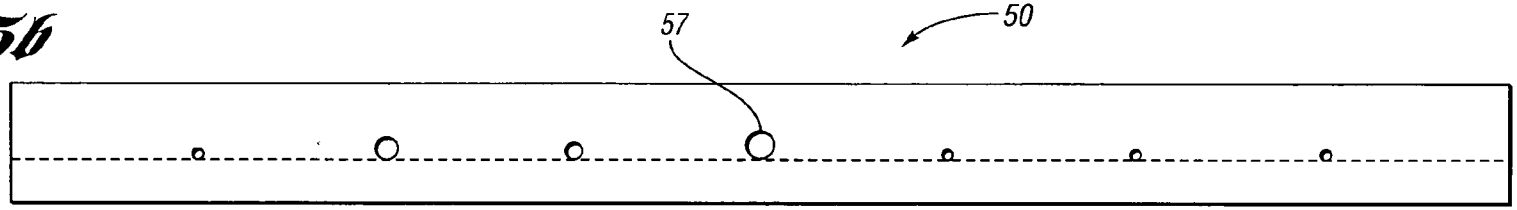
Figure 5C:
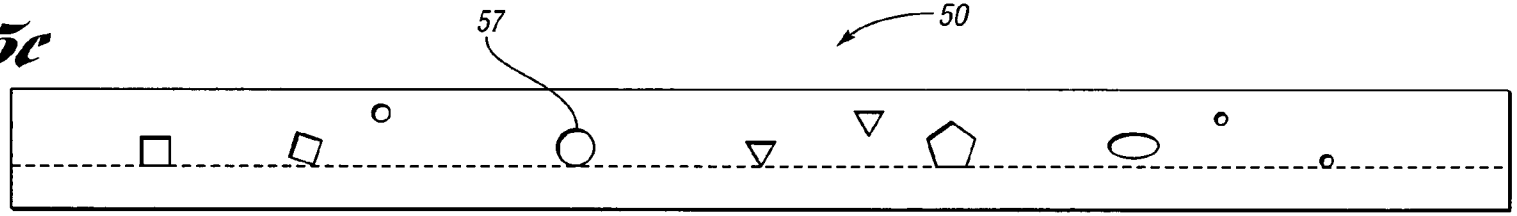
Figure 5D:
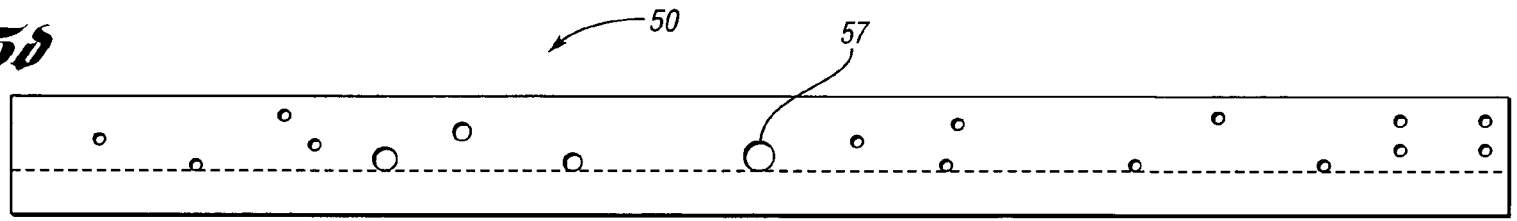
Figure 5E:
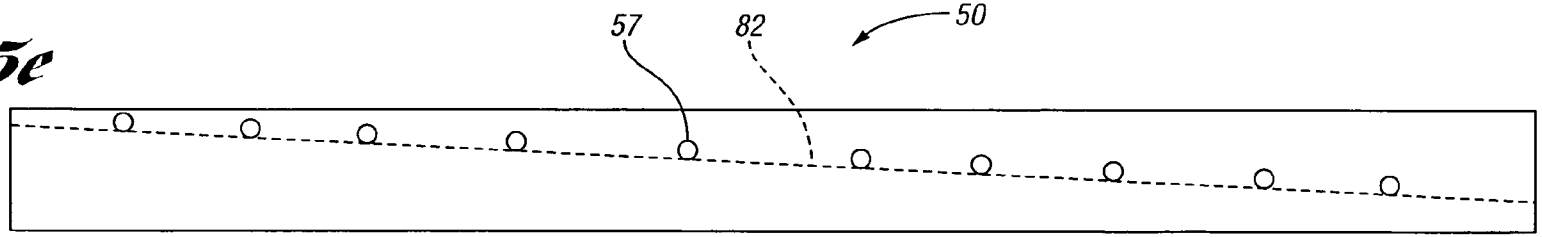
Figure 5F:
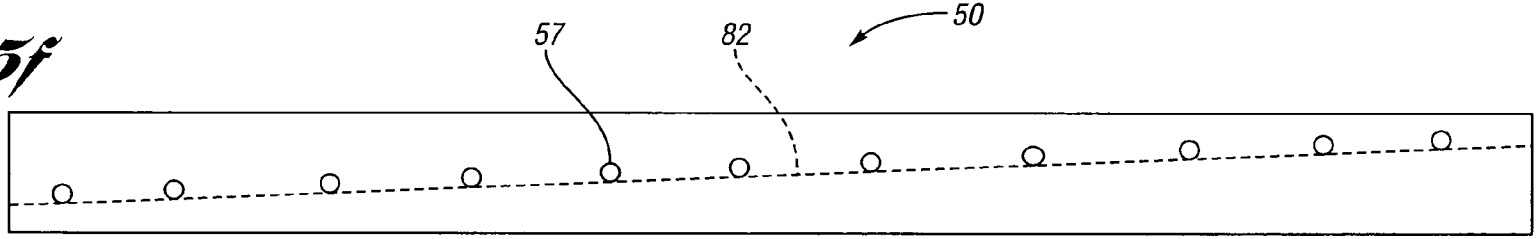
Figure 5G:
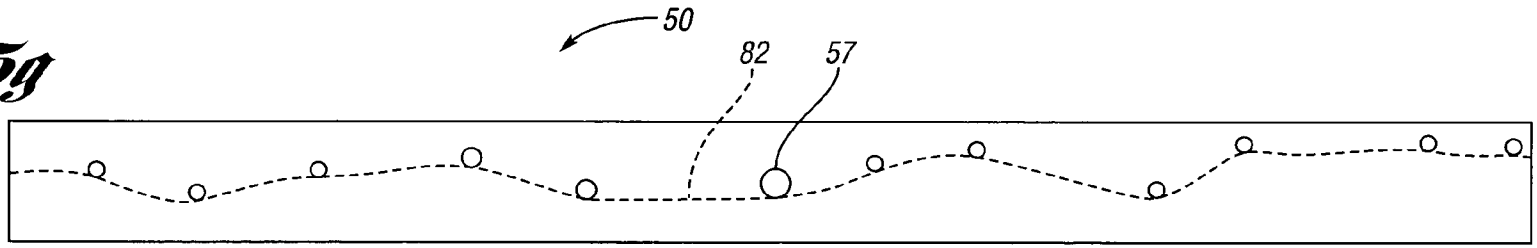

FIGS. 5*a*-5*g* show various designs for the openings 57 defined by the distributor plate 50. More specifically, the openings 57 have varying cross-sectional areas and varying shapes to improve the liquid distribution among the flow tubes 18. An optimal shape and size for each of the openings 57 may be determined by testing distributor plates having different opening parameters. Furthermore, the openings 57 may cooperate with each other to define alternative an alternative boundary 82 to that shown in FIG. 2. More specifically, the boundary 82 may have a decreasing slope (FIG. 5*e*) with respect to the longitudinal direction 29, an increasing slope (FIG. 5*f* with respect to the longitudinal direction 29, or the boundary may have a non-linear shape (FIG. 5*g*). The optimal shape and location of the boundary may be determined based on a number of factors, such as experimental flow rate parameters, angle of the evaporator 10 within the motor vehicle, or other factors that affect fluid flow.

Figure 6:
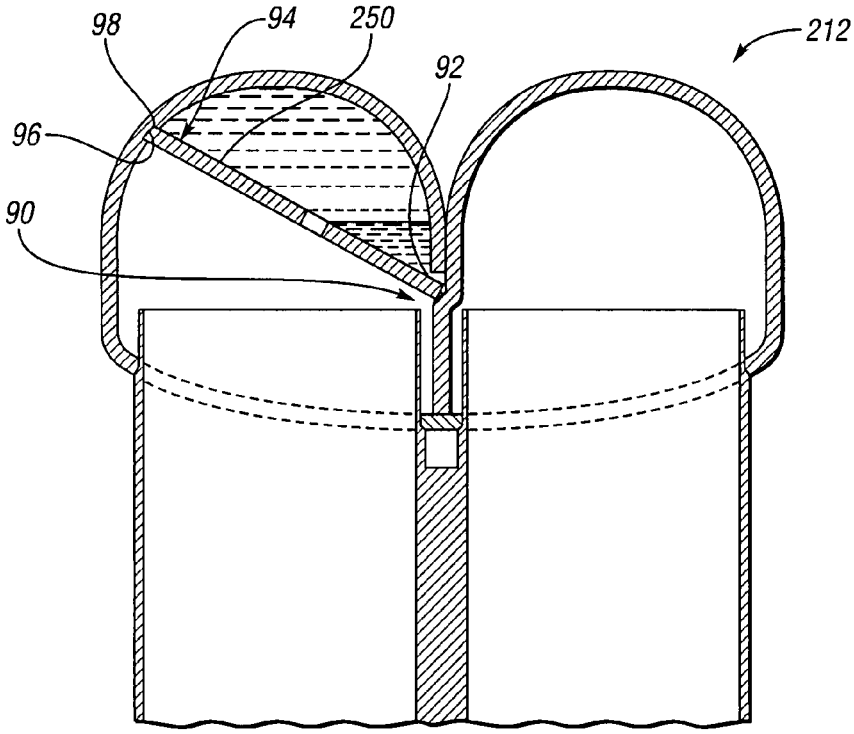
FIG. 6 is a cross-sectional view, similar to that shown in FIG. 4, of yet another alternative embodiment of the present invention.

In an alternative design, shown in FIG. 6, the top header 212 is assembled by connecting a distributor plate 250 to a separately-formed top header 212. The top header 212 is genreally formed in a manner similar to that described above with respect to FIGS. 1-3. However, the distributor plate 250 is a separate piece inserted into the top header 212 and connected thereto at its opposing side edges. A first connection point 90 for the distributor plate 250 is defined by a ridge 92 formed in a portion of the top header 212. A second connection point 94 is defined by a slot 96 formed within another portion of the top header 212 and receives a portion 98 of the distributor plate 250. However, any suitable configuration for connecting points of the respective components 212, 250 may be used.

Figure 7:
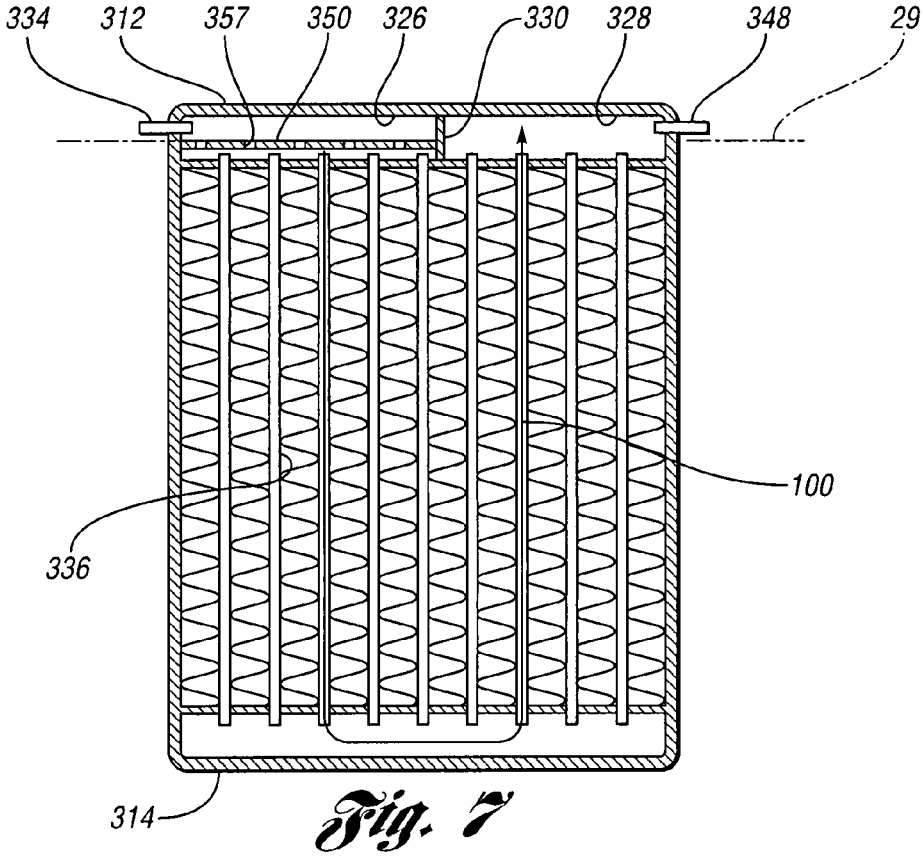
FIG. 7 is a cross-sectional view of another alternative embodiment of a heat exchanger embodying principles of the present invention.

Referring now to FIG. 7, an alternative embodiment of the evaporator is illustrated therein. The evaporator 310 shown in FIG. 7 includes a top header 312 having a transversely-extending divider plate 330 that separates the top header 312 into an inlet tank 326 and an outlet tank 328. Unlike the design shown in FIG. 1, the respective tanks 326, 328, and thus the respective sets of flow tubes 336, 346, are located end to end with each other rather than side to side. A distributor plate 350 is provided in the inlet tank 336 as per one of the previous embodiments. In this design, the refrigerant flows into the inlet tank 326 via an inlet 334, through openings 357 in a distributor plate 350 and into the first set of tubes 336. The refrigerant then flows along a flowpath 100 into the bottom header 314 and up the second set of flow tubes 346. Finally, the refrigerant flows into the outlet tank 328 and out of the top header 312 via an outlet 348.

The design shown in FIG. 7 may be combined with the design shown in FIG. 1, such that the top header is divided into three sections. Furthermore, the present invention may be effectively used in any suitable type of heat exchanger, such as a condenser, a radiator, or a heater core. Also, the present invention may be used with any suitably-configured heat exchanger, such as a heat exchanger with side-mounted headers or a heat exchanger that is mounted within the motor vehicle on an angle with respect to the direction of the force of gravity.

Figure 8:
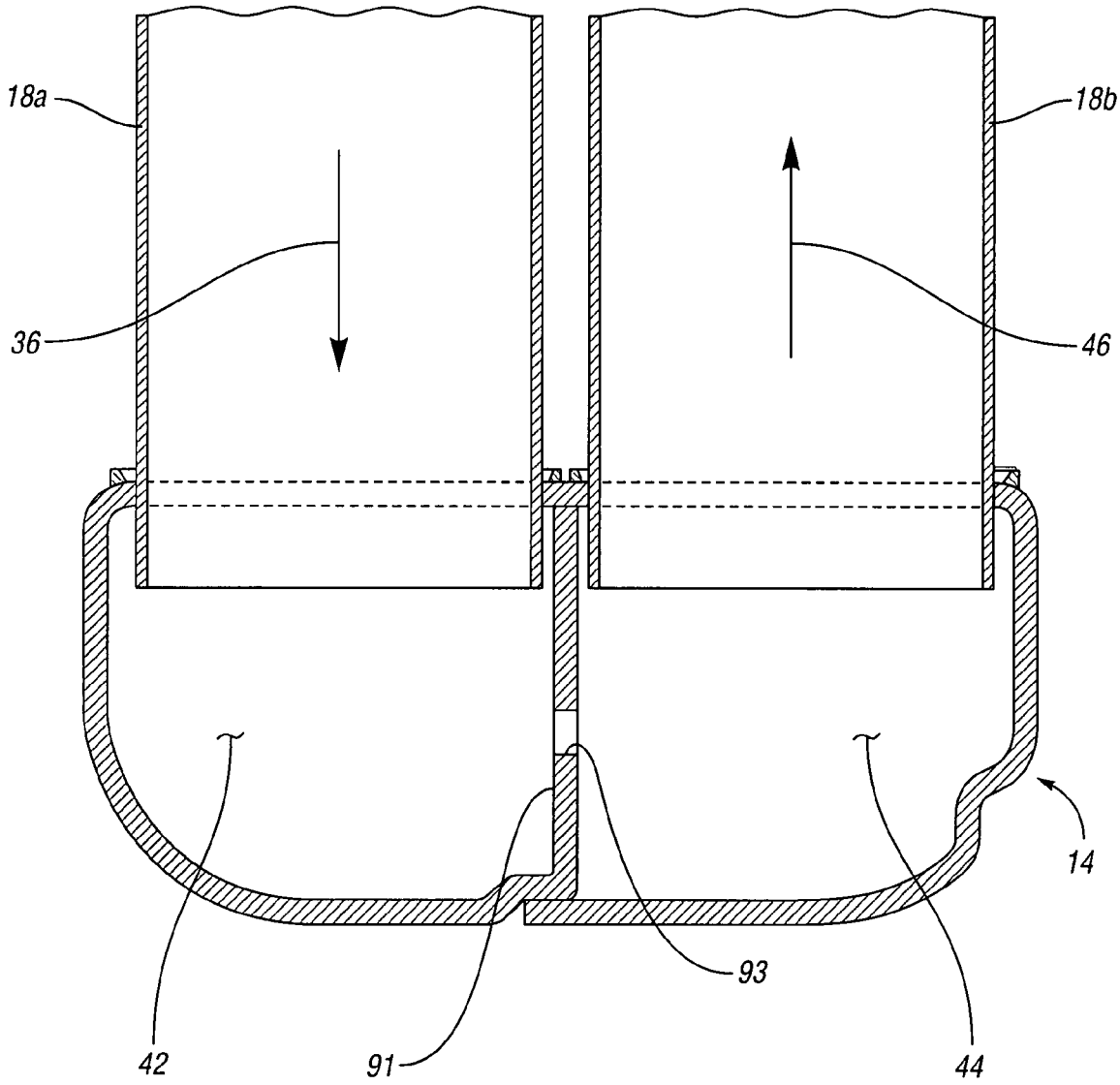
FIG. 8 is a cross-sectional view of a bottom header of another alternative embodiment of the present invention.

As shown in FIG. 8, in another design alternative a second distributor plate 91 may be placed in the bottom header 14 of the evaporator to control the fluid flow rate into or within the bottom header. For example, in FIG. 8 the second distributor plate 91 is used to substantially divide the bottom header 14 into two chambers 42, 44. In this design, the liquid portion of the refrigerant is unable to flow from the first chamber 42 to the second chamber 44 until reaching the height of the opening 93 formed in the second distributor plate 91. In another example, the second distributor plate may be positioned between the flow tubes and the bottom header chamber to control the flow into the bottom chamber. The second distributor plate may be oriented at a number of positions within the bottom header, such as normal to the axis 20, parallel to the axis 20, or any other angle with respect to the axis 20.

As yet another design alternative, the inlet and the outlet may be positioned at the same end of the top header, rather than being positioned on opposite ends of the top header 12 as shown in the figures. Also, the design shown in the figures causes the fluid to flow across the core 16 two times (a.k.a. a double pass heat exchanger), but the present invention may be used with a heat exchanger having any appropriate number of passes. In heat exchangers with an odd number of passes, such as one or three, the inlet is preferably located at the top of the heat exchanger and the outlet is located at the bottom.

It is therefore intended that the foregoing detailed description be regarded as illustrative rather than limiting, and that it be understood that it is the following claims, including all equivalents, that are intended to define the spirit and scope of this invention.

What is claimed is:

1. A heat exchanger for a vehicle comprising:

a first header extending longitudinally to define a passageway;

a second header defining a second passageway;

a core having a set of flow tubes extending between the first and second headers; and a distributor plate extending longitudinally within the first header to divide the passageway into first and second chambers;

wherein the distributor plate defines a collection area for collecting a liquid and defines an opening that fluidly connects the first and second chambers to each other, the opening defining a boundary of the collection area such that the liquid is substantially prevented from flowing through the opening until reaching the boundary of the collection area.

2. A heat exchanger as in claim 1, wherein the distributor plate defines a length extending along the passageway, and wherein the distributor plate is configured such that the liquid collected in the collection area is distributed substantially evenly along the length of the distributor plate.

3. A heat exchanger as in claim 2, wherein the distributor plate is configured such that the liquid collected in the collection area is distributed substantially evenly along the length of the distributor plate when the liquid is flowing at a relatively low flow rate.

4. A heat exchanger as in claim 1, wherein the distributor plate defines a plurality of openings that each fluidly connects the first and second chambers, and the plurality of openings cooperate to define the boundary of the collection area.

5. A heat exchanger as in claim 4, wherein the distributor plate is configured to permit the liquid to flow substantially equally through each of the plurality of openings.

6. A heat exchanger as in claim 5, wherein at least two of the plurality of openings define unequal cross-sectional areas.

7. A heat exchanger as in claim 1, wherein a wall of the first header cooperates with the distributor plate to define the collection area.

8. A heat exchanger as in claim 1, wherein the distributor plate includes a trough portion defining the collection area.

9. A heat exchanger as in claim 8, wherein the trough portion defines a generally arcuate portion.

10. A heat exchanger as in claim 1, wherein the first header includes a divider plate that divides the first header into the passageway and a third passageway.

11. A heat exchanger as in claim 10, wherein the divider plate extends longitudinally along the first header such that the passageway and the third passageway are transversely off-set from each other.

12. A heat exchanger as in claim 11, wherein the first header, the distributor plate, and the divider plate are all formed from a single, unitary component.

13. A heat exchanger as in claim 11, wherein the divider plate extends transversely across the first header such that the passageway and the third passageway are oriented end to end with each other.

14. A heat exchanger as in claim 1, further comprising a second distributor plate longitudinally within the second header to divide the second passageway into first and second chambers.

15. A heat exchanger for a vehicle comprising:

a first header extending longitudinally to define a passageway;

a second header defining a second passageway;

a core having a set of flow tubes extending between the first and second headers along an axis; and a distributor plate extending along a plane within the first header to divide the passageway into first and second chambers, wherein the first header defines an opening that fluidly connects the first and second chambers to each other, and wherein the plane and the axis define an angle with respect to each other that is greater than 0 degrees and is less than 90 degrees.

16. A heat exchanger as in claim 15, wherein the distributor plate defines a plurality of openings fluidly connecting the first and second chambers and wherein cooperating with each other to define a boundary of a collection area such that a liquid present within the first chamber is substantially prevented from flowing through the opening until reaching the boundary of the collection area.

17. A heat exchanger as in claim 16, wherein the liquid is substantially prevented from flowing through the opening until reaching the boundary of the collection area when the liquid is flowing at a relatively low flow rate.

18. A heat exchanger as in claim 17, wherein the angle is equal to a predetermined value such as to reduce turbulence of the liquid flow through the first header.

19. A heat exchanger as in claim 15, wherein the angle is between 35 and 85 degrees.

20. A heat exchanger as in claim 19, wherein the angle is greater than 45 degrees.

21. A heat exchanger as in claim 20, wherein the angle is between 60 degrees and 70 degrees.

22. A heat exchanger as in claim 15, wherein the collection area extends longitudinally and generally perpendicular to the axis of the flow tubes.

23. A heat exchanger as in claim 15, wherein the first header, the distributor plate, and the divider plate are of a unitary construction.

24. A heat exchanger as in claim 15, further comprising a second distributor plate longitudinally within the second header to divide the second passageway into first and second chambers.

25. A heat exchanger for a vehicle comprising:

a first header extending longitudinally to define a passageway, wherein a portion of the first header defines a distributor plate extending longitudinally within the first header to divide the passageway into first and second chambers, the distributor plate defining a collection area for collecting a liquid;

a second header defining a second passageway; and a core having a set of flow tubes extending between the first and second headers;

wherein the distributor plate and the first header are a single, unitary component, and wherein the distributor plate defines an opening that fluidly connects the first and second chambers to each other.

26. A heat exchanger as in claim 25, wherein the first header includes a divider plate that divides the first header into the passageway and a third passageway.

27. A heat exchanger as in claim 26, wherein the divider plate extends longitudinally along the first header such that the passageway and the third passageway are transversely off-set from each other.

28. A heat exchanger as in claim 26, wherein the first header, the distributor plate, and the divider plate are all formed from a single, unitary component.

* * * * *